United States Patent [19]

Westerman Jr.

[11] Patent Number: 4,882,016

[45] Date of Patent: Nov. 21, 1989

[54] IN-SITU SURFACE TREATMENT CONTAINMENT APPARATUS AND METHOD

[75] Inventor: Everett A. Westerman Jr., Auburn, Wash.

[73] Assignee: The Boeing Company, Seattle, Wash.

[21] Appl. No.: 189,423

[22] Filed: May 2, 1988

[51] Int. Cl.[4] ..... C25D 5/02

[52] U.S. Cl. ..... 204/15

[58] Field of Search ..... 204/15

[56] References Cited

U.S. PATENT DOCUMENTS

| | | | |
|---|---|---|---|
| 2,540,602 | 2/1951 | Thomas et al. | 204/15 |
| 3,294,664 | 12/1966 | Franklin | 204/224 |
| 3,546,088 | 3/1967 | Barkman et al. | 204/224 |
| 3,704,220 | 11/1972 | Ashworth | 204/224 |
| 4,364,799 | 12/1982 | Steiger | 204/15 |

FOREIGN PATENT DOCUMENTS

| | | |
|---|---|---|
| 672698 | 10/1936 | Fed. Rep. of Germany . |
| 328443 | 4/1958 | Switzerland . |
| 406923 | 3/1934 | United Kingdom . |

*Primary Examiner*—T. M. Tufariello
*Attorney, Agent, or Firm*—Seed & Berry

[57] ABSTRACT

A method and apparatus for a containment for treating a surface, such as on an aircraft, in-situ. A treating compartment having a conductive screen and an insulating fiber member therein is held in place on the surface by a retaining membrane attached around the periphery of the treating compartment. The treating fluid is held in a separate container that is coupled to the treating compartment. A suction is placed on the treating compartment which pulls the membrane, screen and fiber against the surface and into contact with each other. The suction also pulls the treating fluid into the treating compartment. The fluid spreads evenly along the insulating member disposed between the screen and the surface under treatment. A voltage potential difference is placed between the conductive screen and the surface, causing current to run through the treating fluid to provide treatment of the surface. After the treatment is completed, the suction from the treating compartment is removed and the fluid returned to its container. The retaining membrane is removed and the entire apparatus removed from the surface.

14 Claims, 1 Drawing Sheet

IN-SITU SURFACE TREATMENT CONTAINMENT APPARATUS AND METHOD

DESCRIPTION

1. Technical Field

This invention relates to the chemical treatment of parts on an aircraft, and more particularly, to a method and apparatus for providing containment of an in-situ treatment of the part without removal from the aircraft.

2. Background of the Invention

Most aircraft today use aluminum, both in the interior structure and on the exterior. Frequently, it is necessary to attach articles, such as fittings, antennas, aluminum parts, etc., to the aluminum structure on the aircraft. These items are attached by known methods, including welding, bonding with an adhesive, etc. Further, aluminum sometimes becomes damaged and must be repaired. The damage may be a hole, a scrape, or other damage requiring repair. Repairing damaged aluminum structure often requires attaching or bonding on a repair plate.

The aluminum surface to which the article is to be attached must be properly cleaned and prepared prior to attachment to ensure a tight bond. One method presently used to treat aluminum prior to attachment is phosphoric acid anodizing. Phosphoric acid anodizing cleans dirt and oxide layers from the aluminum and etches the aluminum to provide a clean and bondable surface.

To perform phosphoric acid anodizing, the aluminum surface to be treated must be covered with phosphoric acid. It is critical that the entire surface be covered with acid and that no air pockets exist, thus preventing the acid from contacting the aluminum.

According to present methods used in repairing and constructing an aircraft, a large tank, many feet deep and many feet long, is filled with phosphoric acid. The part to be treated is placed in the phosphoric acid tank. This ensures that the acid fully contacts the surface of the aluminum.

After the aluminum part is in the tank, a negative voltage is placed on the part and a positive voltage is placed on a metal screen spaced away from the surface to be treated. This creates a voltage potential difference between the two conductors, with acid therebetween. Current flows through the acid, completing the circuit, to perform phosphoric acid anodizing. After the prescribed time at the prescribed voltage for the part, as is well known in the art of phosphoric acid anodizing, the voltage is removed and the part is taken from the tank. The surface of the part is now prepared for attachment as by bonding, welding, etc.

The tank for holding the phosphoric acid must be large enough to hold the largest part which is expected to be placed therein. The tanks are often made large enough to hold entire sections of aircraft, including portions of wings, rudders, tail sections, etc. This requires many gallons of acid and large tanks. This is a significant disadvantage of large-tank, phosphoric acid anodizing.

One advantage of the tank method is that all exposed surfaces, without respect to orientation when placed on the aircraft, can be anodized and prepared. The disadvantage is that the part must be small enough to fit into the tank, or alternatively, the tank must be very large.

When an aircraft is fully assembled and has been in use for several years, it is often necessary to perform a repair on the aircraft or bond an item to the aircraft. It is necessary to properly prepare the aluminum surface prior to bonding the item, such as by phosphoric acid anodizing, as described herein. If the tank method of anodizing is used, it is necessary to remove that portion of the aircraft which is to be treated and send it to a repair facility having a large tank so that the part may be properly treated prior to attaching the item. This creates a disadvantage, both in turnaround time and repair cost. It also requires partial disassembling of the aircraft, sending the part to be repaired to a tank, and waiting for return shipment. This is a significant disadvantage for a military aircraft, which may be damaged in service at a site remote from an anodizing tank.

One method of performing phosphoric acid anodizing in the field, in-situ on the aircraft, is known as the Phos-Acid Non-Tank Application (PANTA). PANTA involves placing a damming barrier around the surface to be treated. The barrier is filled with phosphoric acid, and an insulation is placed over the area to be anodized. A metal screen or other suitable conductor is then placed in the phosphoric acid. A voltage potential difference between the two conductors is created, causing current to flow between the conductors through the acid to perform the anodizing. After the anodizing is completed, the acid is removed from the barrier and the barrier is removed from the surface of the plane. The surface area just treated is now ready for priming and attaching an item, as in a bonded repair, welding, etc. While PANTA may be used in the field, it has numerous disadvantageous. A major disadvantage of PANTA is that it can be used only on an upper horizontal surface, such as on the top of a wing. This is a significant limitation and any surfaces that are vertical or on the underside of an aircraft must still be removed from the aircraft and sent to a repair facility for tank anodizing.

SUMMARY OF THE INVENTION

It is an object of this invention to provide a containment method for the treatment of a surface in-situ in both the vertical and horizontal positions.

It is another object of this invention to provide an apparatus to contain a treating fluid and retain it in complete contact with the surface being treated.

It is another object of this invention to provide such an apparatus that is easily portable for performing the fluid treatment at any desired location in the field.

These and other objects of the invention, which are apparent from this description, are accomplished by providing a treating compartment having a treating fluid and a conductive screen therein. A retaining compartment is provided around the periphery of the treating compartment. The retaining compartment is coupled to a vacuum source to hold the treating compartment in the correct position on the surface. An insulating, wicking member for insulating and retaining the treating fluid in a uniform layer between the surface to be treated and the conductive screen is provided. When the insulating fiber and conductive screen are within the treating compartment, the treating compartment is coupled to a vacuum source. When the vacuum is applied, the membrane of the treating compartment is drawn towards the surface to be treated to hold the metallic screen and insulating member in a fixed position. The vacuum also draws the treating fluid into the treating compartment from an attached bag. A voltage potential difference is placed between the metallic screen and the surface, causing a current to flow through the fluid to treat the surface. After the treatment is completed, the vacuum on the treating compartment is removed, permitting the treating fluid to return to its original source. The vacuum on the retaining compartment is removed and the entire assembly is removed from the structure and stored for later use.

A significant advantage of the present invention is its portable nature. Flexible membranes to construct the compartments are preferably made of readily available plastic sheets or vinyl. The airtight seals to the surface are preferably constructed from two-sided duct tape, putty, or other suitable airtight adhesive. The entire treating apparatus may be assembled in a few minutes from a flat, hand-carried kit.

DETAILED DESCRIPTION OF THE PREFERRED EMBODIMENT OF THE INVENTION

Figure 1:
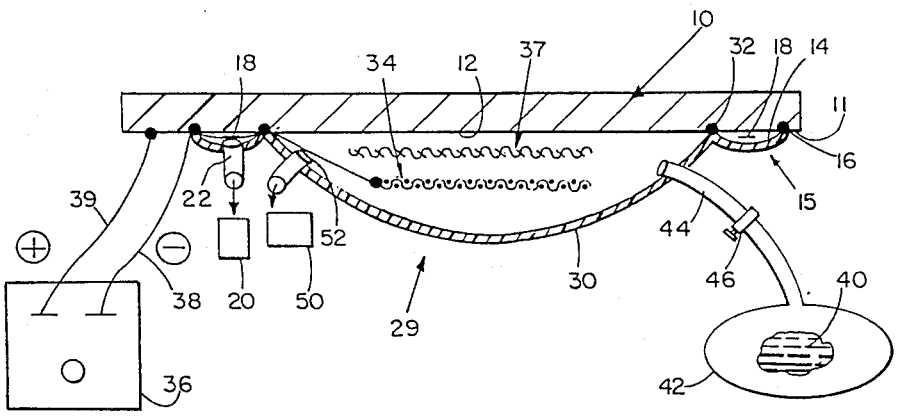
FIG. 1 is a partial cross section of a preferred embodiment of the invention coupled to a surface for treatment.

A part 10 having a surface 11 includes a surface portion 12 to be treated, as shown in FIG. 1. A rectangular retaining membrane 14 and a rectangular treating membrane 30 are attached to the surface 11 with airtight seals 16, 32 to define a surface area of treatment 12. The membranes are a flexible plastic sheet, rubber, vinyl or other airtight flexible membrane. The airtight attaching seals 16 and 32 are formed with a moldable sealing material, such as duct tape, putty, caulking or other known material. A retaining compartment 15 is formed by membrane 14, seals 16 and 32, and surface 11. A treating compartment 29 is defined by treating membrane 30, seal 32, and surface to be treated 12. The retaining compartment 15 extends around the periphery of the treating compartment. The compartment 15 has a spacer fiber 18 disposed between the membrane 14 and the aircraft surface 11. The spacing fiber prevents the membrane from collapsing onto the surface and sealing off the airflow in that part of the compartment. Cheesecloth is often used as the spacing fiber, but other suitable materials that perform the function of keeping the membrane from sealing to the surface when a vacuum is applied are suitable.

A vacuum source 20 is coupled through connection 22 to the interior of the retaining compartment 15. Placing a vacuum on the retaining compartment 15 creates a clamping force that firmly retains the treating compartment 29 and components therein in a sealing relationship with surface 11. While other suitable retaining methods may be used, use of a retaining compartment that is vacuum actuated has the advantage of being a portable compartment and easy to assemble in any desired shape using moldable seals 16 and 32 and large, flexible plastic sheets for the membrane. A vacuum source will usually be available in the field for performing the bonded repair. The retaining force applied by placing a vacuum on compartment 15 has been found to be sufficient to hold a treating membrane in position, even on the underside of a horizontal surface. In the event the surface area to be treated is very large or in a unique position, the retaining compartment 15 can be shaped to fit the application or configured to structurally support the treating compartment 29 in position using different attachment devices.

A treating compartment includes a treating membrane for enclosing fluid used in treating the surface. The treating membrane 30 is attached to surface 11 to define surface treatment area 12 within airtight seal 32. The treating membrane and retaining membrane can be formed using a single, unitary membrane, with airtight seal 32 isolating the two membranes to create the two compartments. Alternatively, the treating membrane can be a separate membrane and made from different material than the retaining membrane.

A conductive screen 34, usually metal, is positioned within treating compartment 29. The conductive screen 34 is coupled to a voltage source 36 through wires 38 and 39 (see FIG. 1). The wire 38 goes through the airtight seals 16 and 32 and is sealed therein to prevent air or fluid leaks around the wire.

An insulating member 37 is disposed between the screen 34 and the surface 12. The member must be electrically insulating to prevent the screen 34 from touching the aircraft treating surface 12 and shorting out the electrical circuit. The member also has absorbing and wicking properties to ensure that the treating fluid 40 is evenly distributed between screen 34 and the treating surface 12. Cheesecloth is a preferred material for this member, though other materials or spacing members having insulating, absorbing and wicking properties are suitable. The insulating member also prevents the membrane 30 from collapsing onto the surface when a vacuum is applied to treating chamber 29. This ensures that the vacuum source and flow of air are not blocked to any portion of the surface being treated. A vacuum source 50 is coupled to the interior of the treating membrane through connection 52.

A treating fluid 40 is held in a container 42 that is coupled to the interior of the treating compartment through connection 44. The container 42 is preferably an airtight, flexible bag that collapses when fluid 40 is removed. Alternatively, the container 42 is a rigid container that is open to the air. A valve 46 may be placed in the tubing 44, if desired, though it is not necessary in the embodiment using only a single treating fluid.

Figure 2:
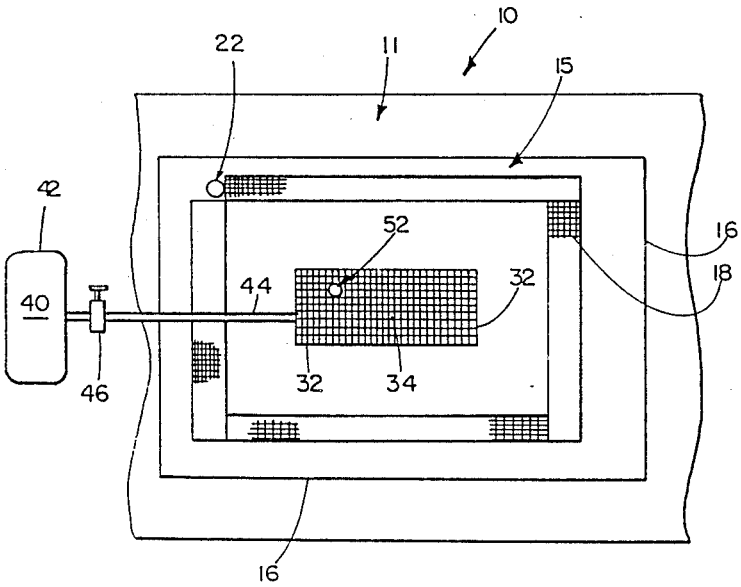
FIG. 2 is a top plan view of the embodiment of FIG. 1.

The preferred method for containing a treatment method of a surface is as follows. A kit is provided that contains the basic materials, e.g., membranes, sealing material, wires, tubing, insulating member, and screen. The kit is small enough to be easily hand-portable. A bag of treating fluid is also provided. The surface area 12 to be treated is identified. If the area is damaged, such as having a hole in the surface, the hole is covered with tape or other suitable sealing means. The size of the area to be covered by both membranes is determined. The covered area must be large enough to allow the treating compartment to cover the surface portion 12 to be treated with the retaining compartment around the periphery of the treating compartment. The retaining compartment may be formed on two sides only and not extended completely around the periphery so long as sufficient force is provided to hold the treating compartment in place. The area is brushed or otherwise cleaned as necessary for preparation for the chemical treatment and attachment of airtight seals. A strip of putty, two-sided duct tape, or other suitable airtight attaching material is placed on the aircraft surface and becomes the outer airtight seal 16. The sealing material surrounds the entire area, as shown in FIG. 2. A second strip of the airtight sealing material to provide inner airtight seal 32 is formed within the area enclosed by the outer seal 16, as shown in FIG. 2. This area must be large enough to enclose the entire area to be treated, with sufficient area at the margins to ensure that the screen is over the surface area of treatment.

Electrical wiring 38 to provide the electrical connection to the screen is placed in the treating area through the sealing material and sealed with an airtight, fluid-tight seal. A conduit 44, such as flexible plastic tubing, to carry the treating fluid 40 is placed in the sealing material in the area to be treated and sealed with an airtight, fluid-tight seal.

A single sheet of the flexible membrane material to cover the entire area is provided. Usually, the sheet will be cut to the desired size from a larger sheet that is provided in the kit. The sheet is cut large enough to cover all of the area within outer airtight seal 16. A spacing member 18, such as a fibrous material, is placed inside the membrane portion 14 corresponding to the retaining compartment 15. This prevents the retaining membrane 14 from collapsing onto the surface and blocking the flow of air when a vacuum is applied. A conductive screen 34 is placed inside the treating membrane in a location corresponding to the area to be treated. An insulating member 37 is placed on top of the screen 34. It is important that the member 37 be larger than the screen to ensure that the screen is electrically insulated from the surface. The insulating member may be soaked in treating fluid prior to placing it inside the membrane on top of screen 34, if desired, though this is not required. The insulating member be selected to be a material that ensures that a complete layer of treating fluid is dispersed between the screen and the surface. The insulating member may have the proper absorbing and wicking qualities to provide that a layer of treating fluid is spread between the screen and the surface. It is important that no air pockets exist in the layer of treating fluid. This ensures that the entire surface is treated and that voids are not left. For some fluids, a layer of any thickness is suitable and variations in treating fluid thicknesses may be permitted. The insulating membrane may have little or no wicking properties for these applications. For other types of treating fluids, the layer must be a minimum thickness or, alternatively, must be exactly even within certain tolerances. This can be accomplished by providing the correct thickness of wicking membrane with the correct properties. Separate wicking and insulating layers of material may be used, either alone or at the same time, to form member 37. A member 37 having layers of insulating and wicking material, either sandwiched or on top of each other, may be used. One layer may provide the insulating properties and the other layer or layers may provide the desired absorbing and wicking properties. A single material member 37 which performs both functions of insulating and wicking, such as cheesecloth, may be used. A second insulating member or fiber member (not shown), such as cheesecloth, may be placed in the membrane prior to placing the screen therein to provide electrical insulation between the screen and the membrane and also to absorb the treating fluid, such as phosphoric acid, to aid in providing an even layer of acid between the screen and the surface to be treated.

After the screen and the cheesecloth are properly positioned in membrane 30, the membrane sheet is attached to the surface of the structure at seals 16 and 32. Additional sealing material is placed on top of the membrane at 16 and 32 to firmly retain the membrane in contact with the surface. The treating membrane is held in position, such as by hand, while the seals at 16 and 32 are completed. A vacuum source is connected through a suitable coupler to the retaining chamber 15, which is now defined by the retaining membrane, seals 16, 32 and the aircraft surface. A vacuum is applied to retaining chamber 15. This permits standard atmospheric pressure of 1 atmosphere, which at sea level is about 14.7 $lbs/in^2$, to be exerted onto the flexible retaining membrane. The force is sufficient to hold the treating membrane onto the surface, whether it is horizontal or vertical. If the sealing material 32 is attached to the surface and the treating membrane 30 with sufficient force to hold treating chamber 29 in position, then retaining chamber 15 is not necessary and may be omitted.

A treating fluid source, such as a flexible, airtight bag 42 of phosphoric acid, is attached to the tubing 44. A vacuum source 50 is connected through a suitable coupler 52 to the treating chamber 29. A vacuum is applied to the treating chamber 29, pulling the membrane 30 tightly against the screen 34 and the insulating member 37. A suitable filter is provided in vacuum coupling member 52 to prevent fluid from entering the vacuum source, if necessary. The insulating and wicking member 37 also provides a space for the treating fluid to enter between the screen 34 and the aircraft surface 12. The treating fluid enters the chamber and is evenly disposed between the screen and the surface by the wicking membrane. The airtight, flexible bag 42 collapses as the fluid enters the chamber. The bag 42 is made of sufficient size that it holds enough fluid to coat the entire surface to be treated. A valve 46 may be provided in the coupling 44 to permit the timing and quantity of fluid flow to be exactly controlled, if desired.

Use of the vacuum and an insulating member 37 comprised of a wicking fiber permits vertical surfaces to be evenly coated with a layer of the treating fluid for proper treatment. This occurs because the vacuum, the absorbing and wicking properties of the insulating fiber, and the membrane ensure that the fluid is evenly dispersed between the screen and the surface, even for vertical surfaces.

After the fluid has entered the treating chamber, a voltage potential difference is applied between the metallic screen and the surface. The screen is coupled to the anode through wire 38 and the surface to the cathode through wire 39, as shown in FIG. 1. The prescribed voltage potential difference is maintained for the prescribed time period, as is well known in the art of phosphoric acid anodizing. After the proper time period has elapsed, the voltage potential difference is removed. The vacuum on the treating chamber 29 is then released.

As the vacuum on treating chamber 29 is released, the treating fluid is drawn from the compartment 29 back into the bag 42. A particular advantage of this embodiment is that handling of and exposure to the treating fluid are prevented. The treating fluid is not exposed to the air or other external environment (other than within chamber 29) throughout the entire treating process and is returned to the original container. This arrangement permits fluids which may be harmful to persons or the environment, if exposure occurs, to be used as the treating chemical and thus provides excellent safety control. This arrangement also permits use of treating chemicals which should not be exposed to the air. After the fluid is removed from the treating membrane, the vacuum on the retaining chamber is removed, permitting removal of the entire assembly from the surface. The membrane and sealing material may be disposed of or retained for later use. The surface has now been prepared for bonding or other further steps.

The treating steps have been described with respect to preparing an aircraft surface for bonding with phosphoric acid anodizing. It is to be understood that many different surfaces can be treated using different treating fluids. For example, the fluid may be an electroplating fluid which is used to plate a specific surface area of any desired contour. The use of a vacuum coupled to a flexible membrane treating chamber with a screen and absorbing members therein ensures that all surface contours are evenly plated. A layer composed of a plurality of different fibers or members having the proper insulating, wicking or absorbing properties may be provided. Alternatively, tubing 44 may be coupled to a plurality of bags having treating chemicals therein for successively treating the surface, each being selectable by suitable valves. The surface is treated with a first fluid or gas, the system purged or cleaned with water from one container, then treated by a second or third fluid, etc.

Alternatively, the treating fluid may be placed in a sealed bag and placed inside the chamber 29, onto the insulating member 37, or behind the screen 34 prior to attaching the treating membrane 30 to the surface. When the vacuum is applied to treating chamber 29, the bag is punctured, such as by a sharp member attached to the screen 34 or the membrane 30. This releases the treating fluid into the chamber to provide the treatment as described herein. The entire apparatus may then be disposed of. This advantageously provides that the treating chemical remains sealed inside in a bag until released within the treating chamber for greater safety and control of the fluid.

I claim:

1. The method of providing a containment for treating a surface in-situ, comprising:

attaching a moldable, sealing material to said surface;

attaching a treating membrane to said moldable sealing material to form a treating chamber, said treating chamber including a conductive screen and an insulating member disposed between said conductive screen and said surface;

creating a vacuum within said treating chamber; and providing a fluid within said treating chamber, said vacuum causing said fluid to be distributed between said conductive screen and said surface.

2. The method according to claim 1 wherein said step of providing a fluid includes placing a sealed bag containing fluid within said treating chamber and creating an opening in said bag when said membrane is moved to provide said fluid supply.

3. The method according to claim 1 wherein said step of providing a fluid includes placing a sealed bag containing said fluid outside of said treating chamber and coupling said fluid to said treating chamber with a tubing.

4. The method of treating a surface in-situ, comprising:

coupling a retaining membrane to said surface with an airtight seal to create a retaining chamber;

coupling a treating membrane to said surface with an airtight seal to create a treating chamber, said treating chamber being surrounded at said surface by said retaining chamber, said treating chamber including a conductive screen and a fiber member disposed between said conductive screen and said surface;

removing air from said retaining membrane to create a suction force for retaining said treating membrane on said surface;

coupling a treating fluid to said treating chamber;

removing air from said treating chamber to create a suction force acting to draw said treating membrane toward said surface and also acting to draw said fluid into said treating chamber;

placing a voltage on said screen to create a voltage potential between said screen and said surface, causing current to flow through said treating fluid;

removing said voltage from said screen;

returning air to said treating chamber; and returning air to said retaining chamber.

5. The method of providing a containment for treating a surface in-situ, comprising:

attaching a sealing material to said surface;

attaching a flexible membrane to said sealing material to form a treating chamber, said treating chamber including a conductive screen and an insulating member disposed between said conductive screen and said surface; and disposing a fluid within said treating chamber disposed between said conductive screen and said surface.

6. The method according to claim 5 wherein said step of providing fluid within said treating chamber includes:

coupling a source of treating fluid to said treating chamber; and placing a vacuum on said treating chamber for drawing said fluid into said treating chamber.

7. The method according to claim 5, further including the step of attaching a sealing material to said membrane and said surface after said membrane is attached to said sealing material.

8. The method according to claim 5, further including the steps of:

attaching a retaining chamber to said surface prior to attaching said treating membrane to said surface; and coupling said treating membrane to said retaining chamber for holding said treating membrane in position on said surface.

9. The method according to claim 5 wherein said treating chamber is formed on an underside of a wing surface of an aircraft.

10. The method of treating a surface in-situ comprising:

coupling a treating membrane to said surface to be treated with an airtight seal to create a treating chamber, said treating chamber including a conductive screen and a fiber member disposed between said conductive screen and said surface;

coupling a source of treating fluid to said treating chamber;

creating a vacuum in said treating chamber to provide a suction force for drawing said treating fluid into said fiber member, said treating fluid being disposed between said conductive screen and said surface;

placing a voltage on said screen to create a voltage potential between said screen and said surface for causing current to flow through said treating fluid;

removing said voltage from said screen; and releasing the vacuum on said treating chamber.

11. The method according to claim 10 wherein said step of coupling a treating membrane to said surface includes the steps of:

attaching a moldable, sealing material to said surface; and attaching said treating membrane to said sealing material to couple said treating membrane to said surface for forming said treating chamber.

12. The method according to claim 10 wherein said treating chamber is formed on the underside of an aircraft surface.

13. The method according to claim 10 wherein said step of coupling a treating fluid to said treating chamber includes the steps of:

placing a sealed bag inside said treating chamber prior to said step of creating a vacuum in said treating chamber, said sealed bag having said treating fluid therein; and opening said bag after said treating chamber is coupled to said surface for disposing said treating fluid in said fiber member.

14. The method according to claim 10 wherein said step of coupling a treating fluid to said treating chamber includes the steps of:

coupling a tubing to said treating chamber, said tubing extending from the interior of said treating chamber to a position exterior of said treating chamber; and coupling a source of fluid to said tubing such that when a vacuum is created in said treating chamber, fluid is drawn from said fluid source, through said tubing and into said treating chamber.

* * * * *